US007770698B2

(12) United States Patent
Okamoto et al.

(10) Patent No.: US 7,770,698 B2
(45) Date of Patent: Aug. 10, 2010

(54) ELEVATOR APPARATUS

(75) Inventors: Ken-Ichi Okamoto, Tokyo (JP); Satoru Takahashi, Tokyo (JP); Takaharu Ueda, Tokyo (JP); Masunori Shibata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 585 days.

(21) Appl. No.: 11/814,039

(22) PCT Filed: Mar. 17, 2006

(86) PCT No.: PCT/JP2006/305408

§ 371 (c)(1),
(2), (4) Date: Jul. 16, 2007

(87) PCT Pub. No.: WO2007/108068

PCT Pub. Date: Sep. 27, 2007

(65) Prior Publication Data

US 2010/0044159 A1 Feb. 25, 2010

(51) Int. Cl.
*B66B 1/32* (2006.01)

(52) U.S. Cl. ..... 187/288; 187/393

(58) Field of Classification Search ..... 187/247, 187/277, 287, 288, 289, 302, 313, 391–393
See application file for complete search history.

(56) References Cited

U.S. PATENT DOCUMENTS 3,917,029 A * 11/1975 Maynard ..... 187/288
4,307,793 A * 12/1981 Caputo ..... 187/297
2007/0272491 A1* 11/2007 Kattainen et al. ..... 187/288
2009/0145698 A1* 6/2009 Kondo et al. ..... 187/288
2009/0223746 A1* 9/2009 Takahashi et al. ..... 187/247
2009/0229924 A1* 9/2009 Kondo et al. ..... 187/288
2009/0255764 A1* 10/2009 Ueda et al. ..... 187/288
2009/0266649 A1* 10/2009 Kondo et al. ..... 187/288
2010/0025162 A1* 2/2010 Okamoto et al. ..... 187/288
2010/0032245 A1* 2/2010 Shibata et al. ..... 187/288

FOREIGN PATENT DOCUMENTS

JP 61-200874 12/1986
JP 3 3874 1/1991
JP 7 157211 6/1995
JP 7-242377 9/1995
JP 2004 231355 8/2004
JP 2006-008333 1/2006

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

In an elevator apparatus, a brake device stops a car from running. The brake device has a power shutoff portion for shutting off a supply of power to a brake opening coil in response to a brake actuation command, and a current adjusting portion for supplying the brake opening coil with power while adjusting an amount of current in response to a deceleration reduction command from a brake control portion. The current adjusting portion can supply the brake opening coil with power even when the supply of power to the brake opening coil is shut off by the power shutoff portion.

5 Claims, 3 Drawing Sheets

ELEVATOR APPARATUS

TECHNICAL FIELD

The present invention relates to an elevator apparatus allowing the deceleration of a car at a time of emergency braking to be adjusted.

BACKGROUND ART

In a conventional brake device for an elevator, the braking force of an electromagnetic brake is controlled at the time of emergency braking such that the deceleration of a car becomes equal to a predetermined value, based on a deceleration command value and a speed signal (for example, see Patent Document 1).

Patent Document 1: JP 07-157211 A

DISCLOSURE OF THE INVENTION

Problem to be solved by the Invention

In the conventional brake device as described above and a braking control device, however, the basic operation of emergency braking and the control of a braking force are both performed by a single braking force control unit, so it requires a long time period to perform calculation for controlling the braking force. As a result, there occurs a delay in generating the braking force.

The present invention has been made to solve the above-mentioned problem, and it is therefore an object of the present invention to obtain an elevator apparatus allowing the operation of emergency braking to be started more reliably and swiftly while suppressing the deceleration at the time of emergency braking.

MEANS FOR SOLVING THE PROBLEMS

An elevator apparatus according to the present invention includes: a car; and a brake device for stopping the car from running. In the elevator apparatus, the brake device includes: a braking force generating portion for generating a braking force; a brake opening coil for generating an electromagnetic force for canceling the braking force against the braking force generating portion; and a power shutoff portion for shutting supply of power to the brake opening coil in response to a brake actuation command. Also, the brake device includes: a brake control portion for monitoring a deceleration of the car and generating a deceleration reduction command when the deceleration of the car becomes equal to or higher than a predetermined value; and a current adjusting portion for supplying the brake opening coil with power while adjusting an amount of current, in response to the deceleration reduction command, the current adjusting portion being capable of supplying the brake opening coil with power even when the supply of power to the brake opening coil is shut off by the power shutoff portion.

BEST MODES FOR CARRYING OUT THE INVENTION

Preferred embodiments of the present invention will be described hereinafter with reference to the drawings.

Embodiment 1

Figure 1:
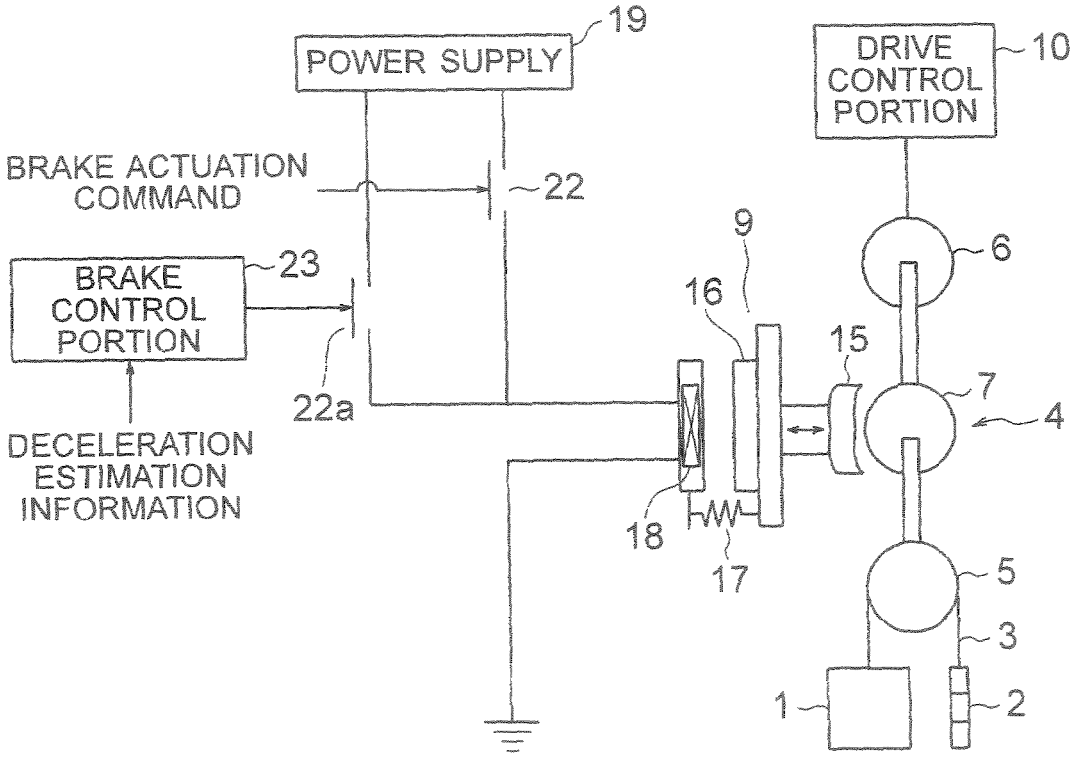
FIG. 1 is a schematic diagram showing an elevator apparatus according to Embodiment 1 of the present invention.

FIG. 1 is a schematic diagram showing an elevator apparatus according to Embodiment 1 of the present invention. Referring to FIG. 1, a car 1 and a counterweight 2 are suspended within a hoistway by a main rope 3. The car 1 and the counterweight 2 are raised/lowered within the hoistway due to a driving force of a hoisting machine 4.

The hoisting machine 4 has a drive sheave 5 around which the main rope 3 is looped, a motor 6 for rotating the drive sheave 5, a brake drum 7 as a brake rotational body that is rotated integrally with the drive sheave 5 as the car 1 runs, and a second brake portion body 9 for braking rotation of the drive sheave 5. The driving of the motor 6 is controlled by a drive control portion 10 as an operation control portion.

The brake portion body 9 has a brake shoe 15 that is moved into contact with and away from the brake drum 7, an armature 16 mounted on the brake shoe 15, a braking spring 17 as a braking force generating portion for pressing the brake shoe 15 against the brake drum 7, and a brake opening coil 18 disposed facing the armature 16 to generate an electromagnetic force for opening the brake shoe 15 away from the brake drum 7 against the braking spring 17.

A brake switch 22 as a power shutoff portion is connected between the brake opening coil 18 and a power supply 19. An adjustment switch 22*a* as a current adjusting portion is connected between the brake opening coil 18 and the power supply 19 in parallel with the brake switch 22.

The brake switch 22 is directly opened/closed depending on whether or not there is a brake actuation command (including a normal braking command and an emergency braking command). That is, when the brake actuation command is generated, the brake switch 22 is opened. When the brake actuation command is canceled, namely, when a brake opening command is generated, the brake switch 22 is closed. The brake actuation command and the brake opening command are generated by an elevator control portion including the drive control portion 10. A normal open/close switch is employed as the brake switch 22.

The adjustment switch 22*a* is normally open. That is, the adjustment switch 22*a* is open except when the deceleration (the absolute value of a negative acceleration) of the car 1 becomes equal to or higher than a predetermined value. Employed as the adjustment switch 22*a* is a switch allowing the amount of the current supplied to the brake opening coil 18 to be adjusted, for example, an open/close switch capable of chopping or a slide switch for continuously changing a resistance value. The following description of Embodiment 4 of the present invention will be given as to a case where the open/close switch is employed. However, in a case where the slide switch is employed, the switch is slid to change the resistance value instead of being turned ON/OFF.

When the brake switch 22 is opened while the adjustment switch 22*a* is open, the supply of a power to the brake opening coil 18 is thereby shut off, so the brake shoe 15 is pressed against the brake drum 7 by the braking spring 17. When the brake switch 22 is closed, the brake opening coil 18 is thereby supplied with a power, so the brake shoe 15 is opened away from the brake drum 7.

The turning ON/OFF of the adjustment switch 22*a* is controlled by a brake control portion 23. The brake control portion 23 is constituted by a microcomputer having a calculation processing portion (a CPU), a storage portion (a ROM, a RAM, and the like), and signal input/output portions.

The brake control portion 23 monitors a deceleration of the car 1 during the running thereof regardless of whether or not there is a brake actuation command, and controls an electromagnetic force generated by the brake opening coil 18, namely, an open/closed state of the adjustment switch 22*a* such that the deceleration of the car 1 does not become excessively high or low. The brake control portion 23 detects and monitors the deceleration of the car 1 independently of the drive control portion 10. That is, deceleration estimation information for measuring or estimating the deceleration of the car 1 is directly input to the brake control portion 23 from a sensor or the like instead of being input thereto from the elevator control portion.

Available as the deceleration estimation information is information from a hoisting machine rotation detector for detecting rotation of the motor 6, a car position detector provided on a speed governor, a return pulley rotation detector for detecting rotation of a return pulley around which the main rope 3 is looped, a weighing device for detecting a load within the car 1, a speedometer mounted on the car 1, an accelerometer mounted on the car 1, an axial torque meter for detecting an axial torque of the drive sheave 5, or the like. Employable as the rotation detectors and the car position detector are encoders or resolvers.

When the deceleration of the car 1 becomes equal to or higher than a predetermined value, the brake control portion 23 generates a deceleration reduction command. In response to the deceleration reduction command, the adjustment switch 22*a* supplies the brake opening coil 18 with power while adjusting the amount of current, thereby reducing the deceleration of the car 1. In this case, the adjustment switch 22*a* is connected in parallel with the brake switch 22 and hence can supply the brake opening coil 18 with power even when the supply of power to the brake opening coil 18 is shut off by the brake switch 22.

A brake device in Embodiment 1 of the present invention has the brake portion body 9, the brake switch 22, the adjustment switch 22*a*, and the brake control portion 23.

In the elevator apparatus structured as described above, the adjustment switch 22*a* for adjusting a braking force is disposed in parallel with the brake switch 22 in a circuit, and the brake switch 22 is opened immediately in response to a brake actuation command. It is therefore possible to cause the brake portion body 9 to perform braking operation immediately without an operational delay when the brake actuation command is generated.

It is also possible to continue the running of the elevator apparatus while weeping the brake control portion 23 from performing the control of deceleration even when there is a malfunction in the brake control portion 23.

Further, the brake control portion 23 detects and monitors the deceleration of the car 1 independently of the drive control portion 10. It is therefore possible to improve the reliability.

Embodiment 2

Figure 2:
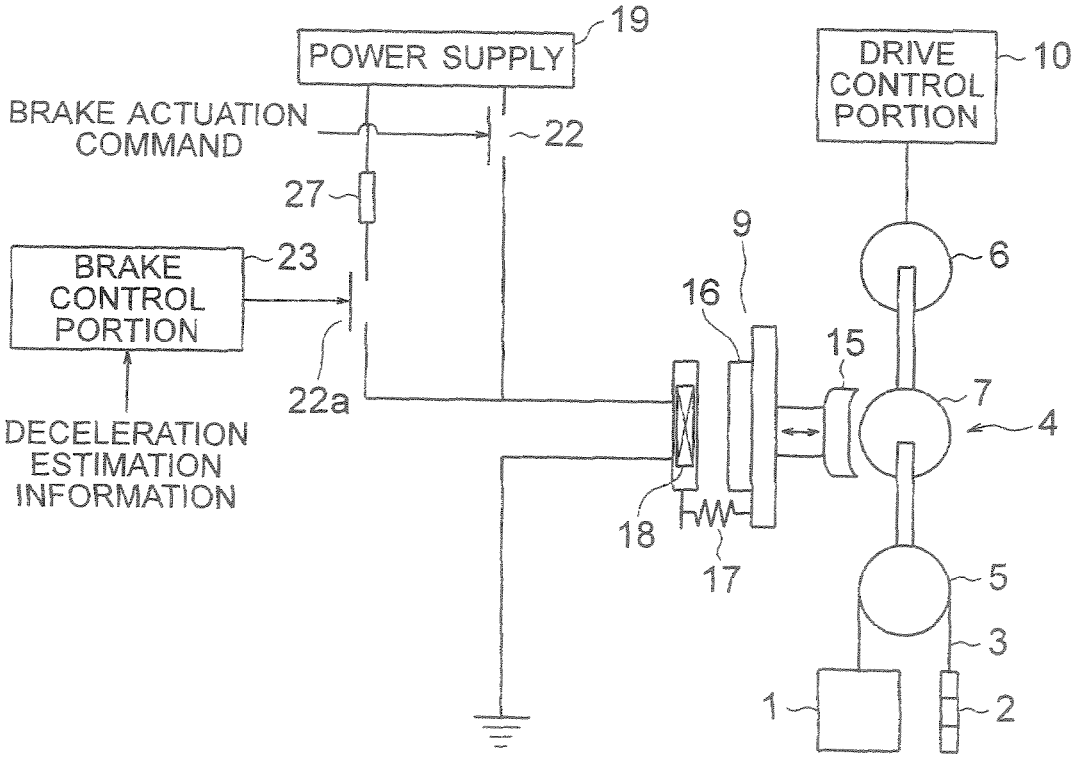
FIG. 2 is a schematic diagram showing an elevator apparatus according to Embodiment 2 of the present invention.

Reference will be made next to FIG. 2. FIG. 2 is a schematic diagram showing an elevator apparatus according to Embodiment 2 of the present invention. Referring to FIG. 2, a current limiter 27 is connected between the power supply 19 and the brake opening coil 18 in series to the adjustment switch 22*a* and in parallel with the brake switch 22. The current limiter 27 limits the current flowing into the brake opening coil 18 through the adjustment switch 22*a*. Employed as the current limiter 27 is, for example, a resistor. Embodiment 2 of the present invention is identical to Embodiment 1 of the present invention in other configurational details and other operational details.

In the elevator apparatus structured as described above, the current limiter 27 is employed to set the upper limit of the amount of the current supplied to the brake opening coil 18 which can be controlled by the brake control portion 23, so only part of a power-supply voltage is applied to one brake opening coil 18. Accordingly, it is possible to suitably limit the amount of the control of the brake portion body 9 by the brake control portion 23.

Embodiment 3

Figure 3:
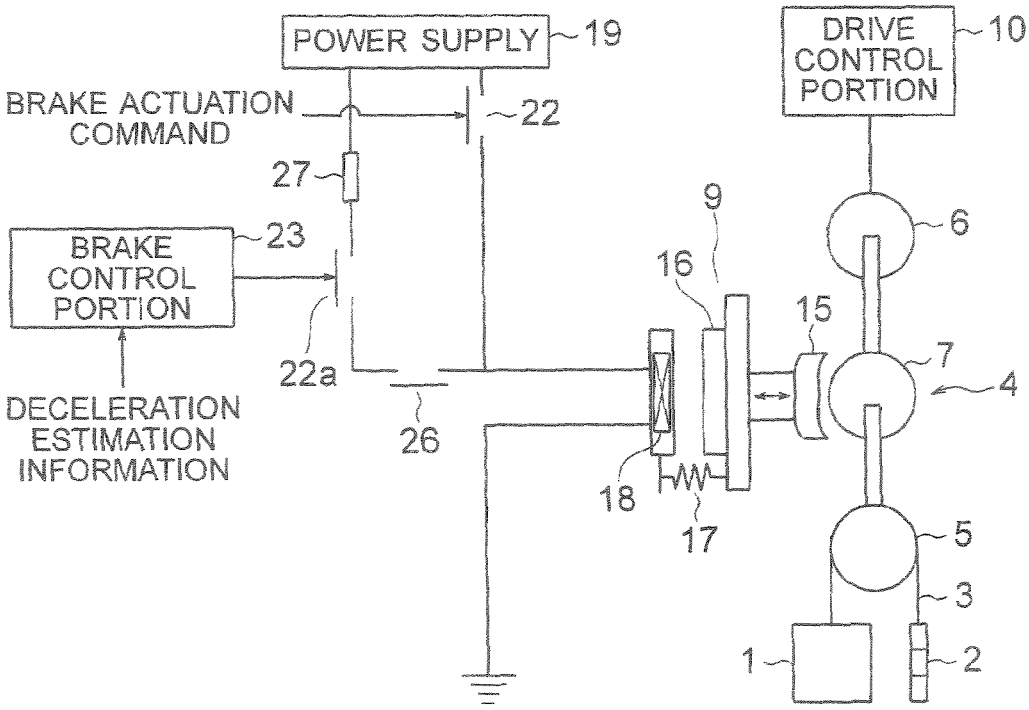
FIG. 3 is a schematic diagram showing an elevator apparatus according to Embodiment 3 of the present invention.

Reference will be made next to FIG. 3. FIG. 3 is a schematic diagram showing an elevator apparatus according to Embodiment 3 of the present invention. Referring to FIG. 3, a forcible braking switch 26 is connected between the brake opening coil 18 and the power supply 19 in series to the adjustment switch 22*a* and the current limiter 27 and in parallel with the brake switch 22.

The forcible braking switch 26 is normally closed. The forcible braking switch 26 is opened in response to an external signal. When the forcible braking switch 26 is opened while the brake switch 22 is open, the control performed by the brake control portion 23 is thereby invalidated, so the brake portion body 9 is forced to generate a total braking force. Embodiment 3 of the present invention is identical to Embodiment 2 of the present invention in other configurational details and other operational details.

In the elevator apparatus structured as described above, the forcible braking switch 26 is provided between the brake opening coil 18 and the power supply 19. It is therefore possible to invalidate the control performed by the brake control portion 23 according to need, and cause the brake portion body 9 to perform braking operation immediately.

Embodiment 4

Figure 4:
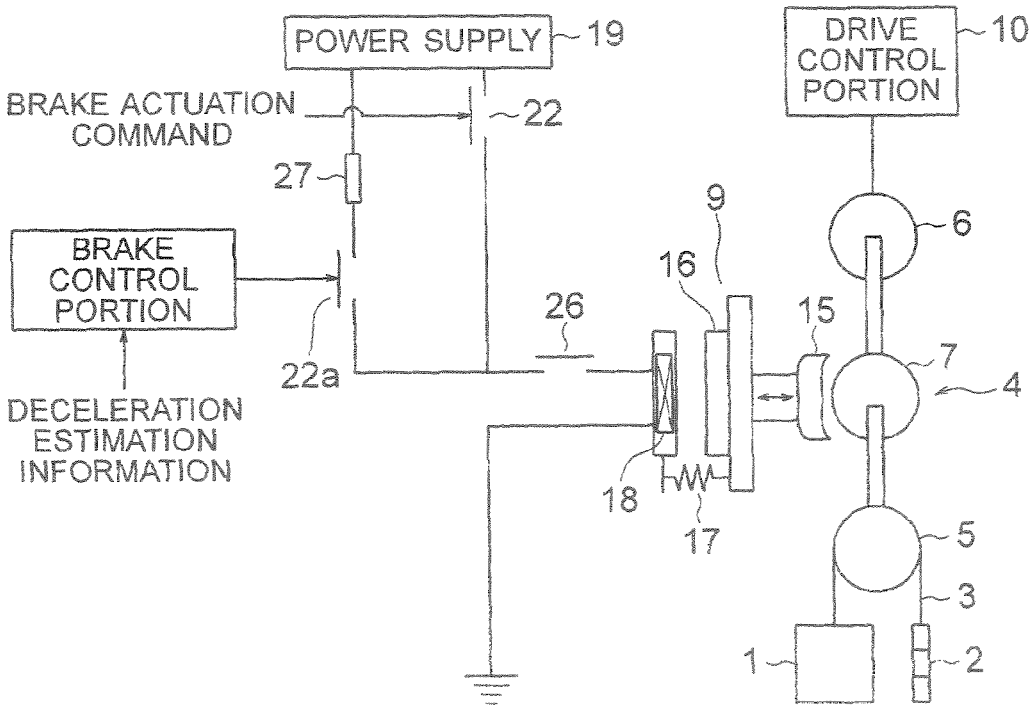
FIG. 4 is a schematic diagram showing an elevator apparatus according to Embodiment 4 of the present invention.

Reference will be made next to FIG. 4. FIG. 4 is a schematic diagram showing an elevator apparatus according to Embodiment 4 of the present invention. In this example, the forcible braking switch 26 is disposed at the highest level of all the circuit elements. That is, the forcible braking switch 26 is connected in series to the circuit including the brake switch 22, the adjustment switch 22*a*, and the current limiter 27.

In the elevator apparatus structured as described above, it is possible to invalidate both the control performed by the brake control portion 23 and the state of the brake switch 22 according to need, and cause the brake portion body 9 to perform braking operation immediately.

Although the brake control portion 23 is constituted by the computer in the foregoing examples, an electric circuit for processing analog signals may be employed to constitute the brake control portion 23.

Further, although the brake device is provided on the hoisting machine 4 in the foregoing examples, it is also appropriate to provide the brake device at another position. That is, the brake device may be a car brake mounted on the car 1, a rope brake for gripping the main rope 3 to brake the car 1, or the like.

Still further, the brake rotational body is not limited to the brake drum 7. For example, the brake rotational body may be a brake disc.

Yet further, the brake device is disposed outside the brake rotational body in the foregoing examples. However, the brake device may be disposed inside the brake rotational body.

Further, the brake rotational body may be integrated with the drive sheave 5.

Still further, the current adjusting portion may be provided in a system different from a system provided with the power shutoff portion to make it possible to supply the brake opening coil 18 with power regardless of the state of the power shutoff portion. For example, the current adjusting portion may be connected to a power supply different from the power supply 19 to which the power shutoff portion is connected.

Yet further, although only one brake device is illustrated in each of the foregoing examples, a plurality of brake devices may be provided for a single brake rotational body.

Although the brake control portion 23 monitors the deceleration of the car 1 regardless of whether or not there is a brake actuation command in the foregoing examples, it is also appropriate to input a brake actuation command to the brake control portion 23 and permit the control of the deceleration of the car 1 only when the brake actuation command is generated.

The invention claimed is:

1. An elevator apparatus, comprising:

a car; and a brake device for stopping the car from running, wherein:

the brake device comprises:

a braking force generating portion for generating a braking force;

a brake opening coil for generating an electromagnetic force for canceling the braking force against the braking force generating portion;

a power shutoff portion for shutting supply of power to the brake opening coil in response to a brake actuation command;

a brake control portion for monitoring a deceleration of the car and generating a deceleration reduction command when the deceleration of the car becomes equal to or higher than a predetermined value; and a current adjusting portion for supplying the brake opening coil with power while adjusting an amount of current, in response to the deceleration reduction command, the current adjusting portion being capable of supplying the brake opening coil with power even when the supply of power to the brake opening coil is shut off by the power shutoff portion.

2. The elevator apparatus according to claim 1, wherein:

the power shutoff portion is a brake switch connected between the brake opening coil and a power supply to be opened in response to the brake actuation command;

the current adjusting portion is an adjustment switch connected between the brake opening coil and the power supply in parallel with the brake switch; and the adjustment switch is normally open.

3. The elevator apparatus according to claim 1, further comprising an operation control portion for controlling operation of the car, wherein the brake control portion detects the deceleration of the car independently of the operation control portion.

4. The elevator apparatus according to claim 1, wherein the brake device further has a current limiter for limiting a current flowing into the brake opening coil through the current adjusting portion.

5. The elevator apparatus according to claim 1, wherein the brake device further has a forcible braking switch connected in series to the current adjusting portion to invalidate control performed by the brake control portion in response to an external signal and hence forcibly cause generation of a total braking force.

* * * * *